United States Patent [19]

Sarumaru

[11] Patent Number: 4,598,903

[45] Date of Patent: Jul. 8, 1986

[54] BOARD FOR FEEDING SINGLE SHEET PAPER

[76] Inventor: Masahiko Sarumaru, 2-7, Hama Khoshien 3-chome, Nishinomiya-shi, Japan

[21] Appl. No.: 620,155

[22] Filed: Jun. 13, 1984

[30] Foreign Application Priority Data

Jun. 17, 1983 [JP] Japan ..... 58-093684[U]

[51] Int. Cl.[4] ..... B65H 5/00

[52] U.S. Cl. ..... 271/264; 271/1; 271/277; 400/622; 226/74

[58] Field of Search ..... 271/264, 277, 1; 400/622, 623, 616, 616.1, 616.2, 616.3; 355/75, 76; 226/162, 167, 74; 428/131, 137

[56] References Cited

U.S. PATENT DOCUMENTS 1,351,454 8/1920 Wherry ..... 421/131 X

FOREIGN PATENT DOCUMENTS 602352 7/1978 Switzerland ..... 400/622

OTHER PUBLICATIONS

Gontier, "Feeding Device for Special Prints," *IBM Technical Disclosure,* vol. 6, No. 2, Jul. 1963, pp. 24–25.

*Primary Examiner*—Bruce H. Stoner, Jr.
*Assistant Examiner*—Matthew C. Graham
*Attorney, Agent, or Firm*—Koda and Androlia

[57] ABSTRACT

A board for feeding a single sheet of paper including holes for paper-feeding which are to be engaged by the sprocket for a paper-feeder of a printer formed at specified intervals on both sides thereof and a part for gripping the rear end of the single sheet of paper and a part for gripping the front end of the single sheet of paper respectively formed on the surface of the board at a specified distance between them in the paper-feeding direction.

1 Claim, 9 Drawing Figures

BOARD FOR FEEDING SINGLE SHEET PAPER

BACKGROUND OF THE INVENTION

1. Field of the Invention

The present device relates to a board for feeding a single sheet paper which permits printing on the single sheet, while utilizing a continuous process sheet feeding mechanism (CPSFM) in a printer adapted for use of continuous sheet paper as the printing paper.

2. Prior Art

For a printer used as an output device of computers, normally continuous sheet paper or the single sheet paper is adaptable as a printing paper. When continuous sheet paper is to be employed, a CPSFM for continuously feeding the sheet paper to the printer is provided on the printer. On the other hand, when single sheet paper is used, an inserter or single sheet paper feeder is provided on the printer beforehand. In many such a printer, once it was equipped with a CPSFM, it could not afford to be operated on single sheet paper, unless this CPSFM is taken off and, therefore, it was virtually impossible to appropriately switch the typing outputs of a printer between continuous sheet paper and single sheet paper.

SUMMARY OF THE INVENTION

The object of this device is to simplify the switching of the typing outputs to single sheet paper in any printer equipped with a CPSFM.

The above mentioned object is accomplished by a unique board for feeding single process slip paper including holes for paper-feeding which are engaged by a sprocket for paper-feeding of the printer formed at specified intervals on both sides thereof and a first gripping part for gripping the rear end of the single sheet paper and a second gripping part for gripping the front end of the single sheet paper respectively formed on the surface of the board with a specified distance between them in the paper-feeding direction to thereby secure the single sheet paper by gripping the front and the rear end parts of the paper.

BRIEF DESCRIPTION OF THE DRAWINGS

The principles and objects of the present invention will become more apparent in the following description with reference to the following drawings wherein like reference numerals denote like elements and in which.

DETAILED DESCRIPTION OF THE INVENTION

In the following, a few embodiments of this device are described with reference to the accompanying drawings.

Figure 1:
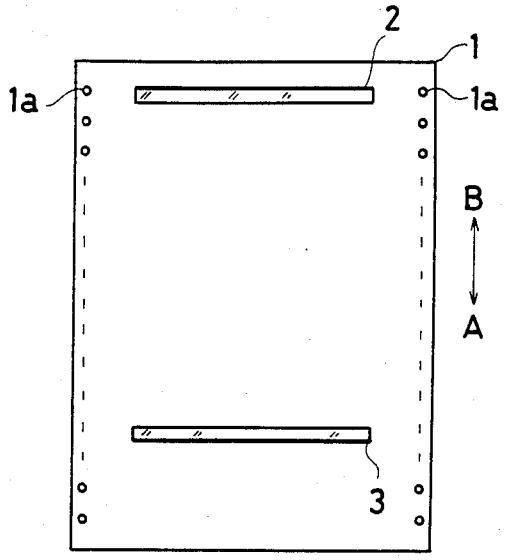
FIG. 1 (A) shows a first embodiment of this device giving its front view, and FIG. 1 (B) of the same figure an enlarged longitudinal sectional view, of which part is cut away.
Figure 1:
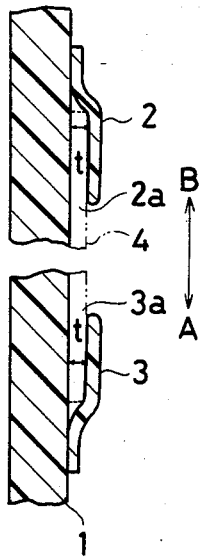

FIG. 1 (A) is a front view of a first embodiment of this device and FIG. 1 (B) is an enlarged longitudinal sectional view of the same, of which part is cut away.

Figure 6:
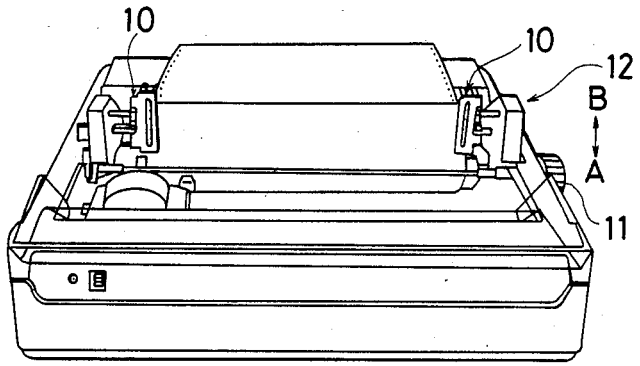
FIG. 6 (A) and (B) are outward views of the printer on which the board of this device is applied and of CPSFM.
Figure 6:
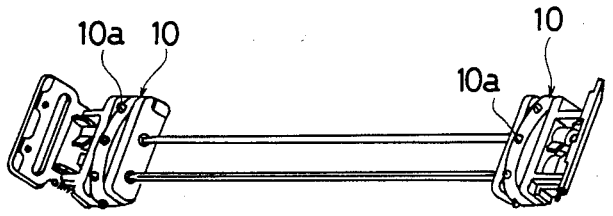

For the board 1, a material such as plastic which is pliable and tough enough to withstand frequently repeated use is used. Its width is set to the same width as that of the normally used continuous sheet paper and its length is set normally within 1 m. On both sides, paper feeding holes 1*a* which are engaged by pins 10*a* of sprocket 10 for a paper-feeder for printer 12 (refer to FIG. 6) are formed at specified intervals.

On the surface of the upper part of the board 1, a wing piece 2 made of plastic in a long strip shape and bent in the lengthwise direction of the board is attached by bonding its upper part thereon and on the surface of the lower part of the board 1, a wing piece 3 of the identical shape as that of the wing piece 2 is attached by bonding its lower part thereon. The wing pieces 2 and 3 made of plastic are formed of a relatively elastic material and properly bent, so that a clearance a little smaller than the thickness of a single sheet of paper 4 is formed between these pieces and the board surface, as shown in FIG. 1 (B). As the wind piece 2 made of plastic has its upper part attached on the board surface and the wing piece 3 has its lower part attached on the board surface, the opening part 2*a* is directed toward the reverse paper feeding direction A and the opening part 3*a* is directed toward the normal paper feeding direction.

In the board 1 composed as above-described, the front end part of the single sheet of paper 4 is inserted upward into the opening part 2*a* of the wing piece 2 made of plastic, to be gripped between the board surface and the under surface of the wing piece 2, as shown in FIG. 1 (B), and further, the lower end part of the single sheet of paper 4 is inserted downward into the opening part 3*a*, to be gripped between the board surface and the under surface of the wing piece 3. As a result, it is possible to hold a single sheet of paper 4 on the board 1. As the board 1 is set, with the holes 1*a* for paper-feeding formed at both sides of the board 1 engaged by pins 10*a* of the sprocket 10 of the paper-feeder of the printer 12 shown in FIG. 6, it is possible to do typing on this single sheet of paper 4. After accomplishing the typing, the single sheet of paper 4 may be taken off by the reverse procedure described above. If typing is desired to be done on a following single sheet of paper, again the upper part and the lower part of the single sheet of paper are secured by gripping them with the wing pieces made of plastic 2 and 3.

Figure 2:
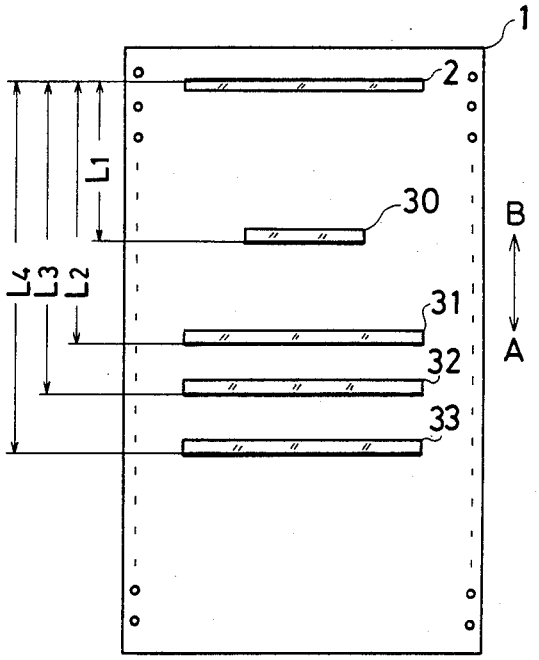
FIG. 2 presents a front view of the second embodiment of this device.

FIG. 2 shows a second embodiment of this device. What differentiates it in structure from the above described first embodiment is that the paper rear end gripping part for gripping the lower end part of the single sheet of paper 4 is composed of four wing pieces 30 through 33 which are made of plastic. In this instance, the distance between the upper side wing piece 2 made of plastic being the paper front end gripping part and the wing piece 30 is set to the length L1 in the longitudinal direction of a postal card; the distance L2 between the wing piece 2 and the wing pieces 31 is set to the length in the longitudinal direction of B5 paper size; the distance L3 between the wing piece 2 and the wing piece 32 is set to the length in the longitudinal directin of A4 size paper; and the distance L4 between the wing piece 2 and the wing piece 33 is set to the length in the longitudinal direction of the letter size. By making use of such a structure, postal cards and a plural number of sizes of paper covered by certain paper size standards may be put to use.

Figure 3:
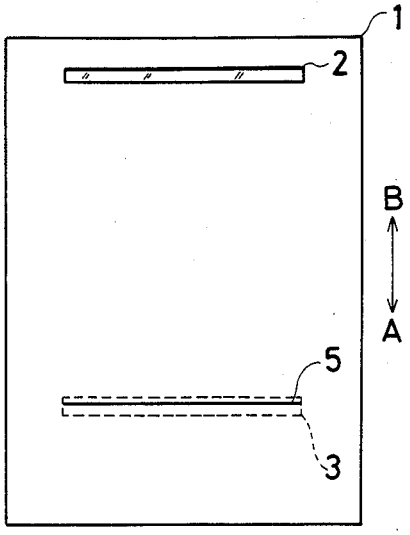
FIG. 3 (A) shows a third embodiment of this device of this figure giving its front view, and FIG. 3 (B) of this figure an enlarged longitudinal sectional view, of which part is cut away.
Figure 3:
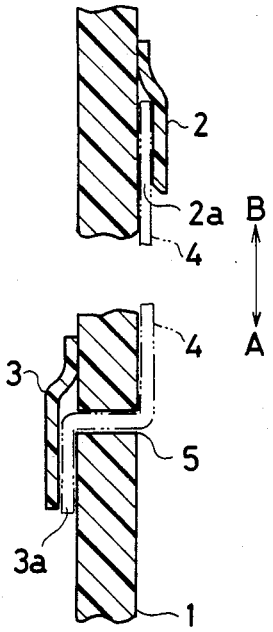

FIG. 3 (A) and FIG. 3 (B) exhibit a third embodiment of this device. FIG. 3 (A) shows its front view and FIG. 3 (B) shows a longitudinal sectional view of FIG. 3 (A) of which part is cut away.

What differentiates this embodiment in structure from the board 1 shown in FIG. 1 is that the wing piece 3 made of plastic being the paper rear end gripping part is attached on the back surface of the board and a cut-out part 5 for passing the paper rear end part through is formed through the part of the board 1 on which the wing piece 3 is attached, and that the wing piece 3 is attached in such a way that its opening part 3*a* is directed toward the reverse paper feeding direction A, unlike in the case of the above-described embodiment. Thus when the front end part of the single sheet of paper 4 is fixed by gripping it between the wing piece 2 which is the paper front gripping part and the front surface of the board, as in the embodiment above-described, the paper rear end part is passed through the cut-out part 5 and bent on the back surface of the board, to be secured by gripping it between the lower surface of the wing piece 3 made of plastic at the paper rear end gripping part and the back surface of the board. With such a structure, the wing piece 3 will not be caught by the feeder mechanism of the printer, even if the board 1 moves in the direction of B (paper-feeding direction).

Figure 4:
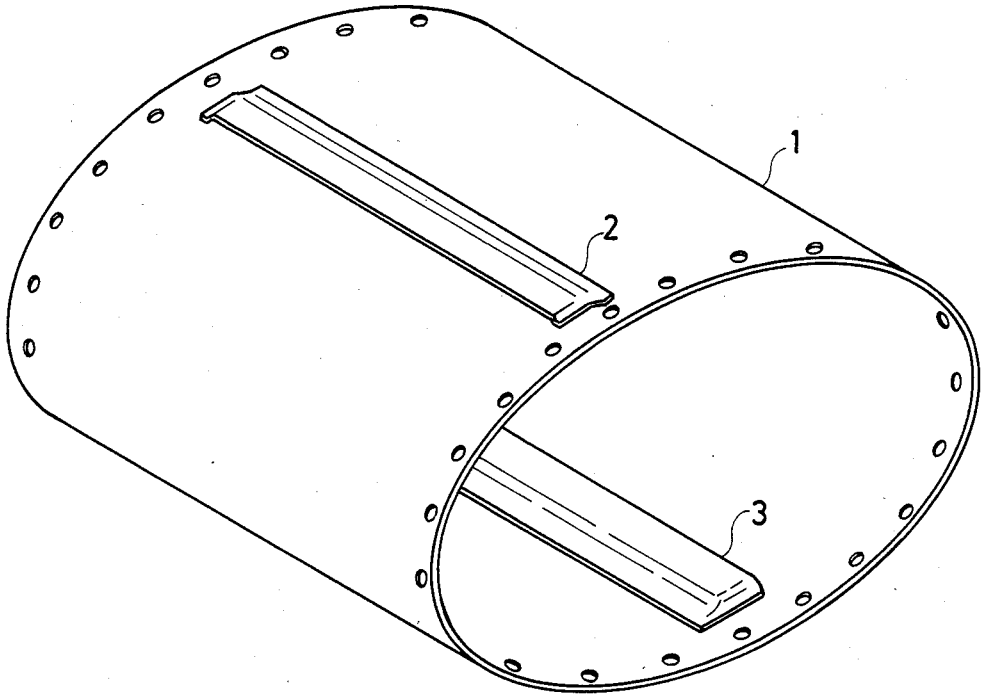
FIG. 4 represents an outward view of a fourth embodiment of this invention.

FIG. 4 shows a fourth embodiment of this device. As shown in the drawing, in this embodiment, the board 1 is formed endless. As in the embodment shown in FIG. 3, the upper side wing piece 2, made of plastic, is the paper front end gripping part and is attached on the front surface of the board 2; but the lower side wing piece 3 made of plastic is attached on the back surface of the board 1. By forming the board 1 endless, it is possible to simply perform typing by merely putting in and taking off the paper, without returning the board to its former position by means of a manual feeding mechanism 11 (refer to FIG. 6).

Figure 5:
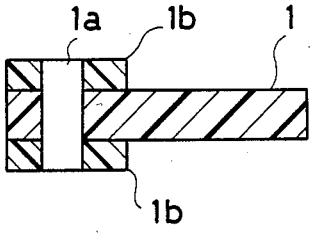
FIG. 5 is an enlarged sectional view of the essential part of a fifth embodiment of this invention.

FIG. 5 gives an enlarged sectional view of the left end part of the board of the fifth embodiment of this device. According to this embodiment, on the front and back surfaces of both sides of the board where the holes 1*a* for paper-feeding are formed, plastic films 1*b* for reinforcing the holes 1*a* for paper-feeding are bonded. Thus by strengthening both sides of the board 1, it is possible to greatly prolong the service life of the board 1.

While in the above-described embodiments, plastic wing pieces are utilized as the paper front end gripping part and as the paper rear end gripping part, other pliable members such as rubber, for example, may be employed. The wing piece is not necessarily in a long strip shape, only if it is adapted to secure a single sheet of paper by gripping it. Further, each of the plastic wing pieces 2 and 3 is so constructed as to be bonded on the board surface; however, these wing pieces may be formed integrally with the board 1 and the film 1*b* shown in FIG. 5 also may be formed integrally with the board 1.

As described in the foregoing, a structure is provided which permits typing on a single sheet of paper when a single sheet of paper is secured to the board 1 by gripping its front and rear end parts on the board 1 and which permits the typing output to be readily delivered to a single sheet of paper, thus greatly reducing changes of output form even in printers provided with CPSFM. Furthermore, a structure is provided which is highly simplified and is low in cost.

It should be apparent to those skilled in the art that the above described embodiments represent but a few of the embodiments of the present invention. Numerous and other varied constructions can be devised by those skilled in the art without departing from the spirit and scope of the present invention.

I claim:

1. A board having two opposite sides for feeding a single sheet of paper characterized in that holes for paper feeding which are to be engaged by a sprocket for paper feeding of a printer are formed at specified intervals on said two opposite sides of said board, a member for gripping a rear end of the single sheet of paper and a member for gripping a front end of the single sheet of paper respectively are formed on a back and a front surface of the board at a specified distance therebetween in the paper feeding direction thereby securing the single sheet of paper to the board by gripping the front and rear end parts of the paper with the paper front and rear gripping members, said paper front end gripping member being formed by bending a wing piece made of plastic in a direction transverse of the board, so that its opening part is directed toward a reverse paper feeding direction, and attaching it on the board front surface and said paper rear end gripping member being formed by bending a wing piece made of plastic in a direction transverse of the board so that the opening part is directed towards a reverse paper feeding direction, and attaching said paper rear end gripping member on the back surface of the board and a cut out part for passing the paper rear end part through the board for attaching the paper rear end part to the paper rear end gripping member.

* * * * *